US006023966A

United States Patent [19]

Mazur et al.

[11] Patent Number: 6,023,966

[45] Date of Patent: Feb. 15, 2000

[54] SAFE BRAKE CUTOUT DETECTION FOR TRAIN

[75] Inventors: Richard J. Mazur; Paul E. Jamieson; John H. Corvin, all of Greer, S.C.

[73] Assignee: Westinghouse Air Brake Company, Wilmerding, Pa.

[21] Appl. No.: 08/803,415

[22] Filed: Feb. 20, 1997

[51] Int. Cl.[7] ..... B60L 1/00; G05D 13/66

[52] U.S. Cl. ..... 73/129

[58] Field of Search ..... 73/121, 129, 118.1, 73/128; 701/19, 34, 20, 43, 45, 70

[56] References Cited

U.S. PATENT DOCUMENTS 4,093,162 6/1978 Takaoka et al. ..... 701/20
4,602,335 7/1986 Perlmutter ..... 701/20

*Primary Examiner*—George Dombroske
*Attorney, Agent, or Firm*—James Ray & Associates

[57] ABSTRACT

A system detects cut-out of brakes on a train in a safe manner. Each vehicle in the train has at least one truck. Each truck has brakes which may be cut-out via a cut-out cock. A frequency generator generates a signal at a predesignated frequency. This signal is conveyed from a first vehicle in the train to a last vehicle in the train along a feed line and from the last vehicle to the first vehicle along a return line. Each cut-out cock assumes an open position wherein the brakes of its truck are cut-in or a closed position wherein the brakes of its truck are cut-out. Each cut-out cock features a switch in series with the return line that closes when its cutout cock assumes the open position or opens when its cutout cock assumes the closed position. A frequency divider for each switch connects in parallel therewith. When the switch is closed, the signal passes through the switch wherein division of frequency is avoided. When the switch is open, the signal passes through the frequency divider wherein division of frequency by a preset value occurs. A detector determines the resulting frequency of the signal returned to the first vehicle on the return line because the signal as it conducted along the return line had its frequency divided each time it passed through one of the frequency dividers. This enables the system to determine the number of trucks whose brakes are cut-out on the train.

20 Claims, 2 Drawing Sheets

SAFE BRAKE CUTOUT DETECTION FOR TRAIN

FIELD OF THE INVENTION

The present invention generally relates to a system for detecting cut-out of brakes on a train. More particularly, the present invention relates to a system for determining automatically the number of trucks whose brakes are cut-out on a train. Still more particularly, the present invention relates to a system that directs a train into a mode of restricted operation if more than a preset percentage of trucks on the train have their brakes cut-out.

BACKGROUND OF THE INVENTION

A train is composed of a plurality of rail vehicles whose brakes are controlled by a brake control system typically located in the lead locomotive of the train. Each rail vehicle in the train has at least one truck. A truck is basically the assembly of parts that together form the structure that supports a rail vehicle at each end. Each truck includes the wheels and axles. Each truck also includes or is at least assigned a brake cylinder control valve and one or more brake cylinders. A brake cylinder control valve is the valve through which the brake control system supplies air to the brake cylinders. The brake cylinder(s) essentially convert the air pressure they receive from the brake cylinder control valve to mechanical force. The brake cylinder(s) transfer this mechanical force to the brakes of the truck. The brakes of the truck then apply to stop the rotation of the wheels on the truck in a manner well known in the brake control art.

The brakes of a truck may be cut-out (i.e., rendered inoperable) via a cut-out cock. A cut-out cock is a manually operated pneumatic valve that is situated between the brake cylinder control valve and the brake cylinder(s) of each truck. Though it is a normally open valve, the cut-out cock may be closed by a railyard worker via a lever or like implement should a problem with the brakes of a truck be detected before a train departs from a station. By closing a cut-out cock, the cut-out cock prevents air from flowing from the brake cylinder control valve to the brake cylinder (s) of its truck thereby depriving the truck of its brakes. Each cut-out cock can thus assume an open position wherein the brakes of its truck are cut-in or a closed position wherein the brakes of its truck are cut-out. Even though a few trucks may have their brakes cut-out, a train can still operate safely as long as the number of affected trucks is not excessive.

Notwithstanding the invention described and claimed in this document, there is no apparatus now in existence that determines automatically whether a train has sufficient number of trucks whose brakes are operable and thus capable of supplying sufficient braking effort to stop the train safely. Prior art methods of determining so typically involve manual inspection of the brake equipment for observable defects as well as manual observation to confirm whether the brakes have responded to commands to apply and release. So it is only during such manual inspection that a railyard worker or train engineer can determine the number of trucks whose brakes have been manually cut-out via the cut-out cock. If more than a given percentage of trucks on the train have their brakes cut-out, the train should not depart until a sufficient number of trucks have been repaired so as to render the train safe to operate.

Though the brakes of a train should always be inspected and observed to assure that they work properly, it would be highly desirable to have a system that can automatically determine whether any, and, if so how many, trucks on the train have their brakes cut-out. It would also be highly desirable to have a system that does so safely and reliably.

The foregoing background information is provided to assist the reader in understanding the invention described and claimed below. Accordingly, any terms used herein are not intended to be limited to any particular narrow interpretation unless specifically stated otherwise in this document.

OBJECTIVES OF THE INVENTION

It is, therefore, a primary objective of the present invention to provide a system for detecting cut-out of brakes on a train.

Another objective of the present invention is to provide a system for determining automatically the number of trucks whose brakes are cut-out on a train.

Yet another objective of the present invention is to provide a system that can direct a train into a mode of restricted operation if more than a preset percentage of trucks on the train have their brakes cut-out.

Still another objective of the present invention is to provide a system for detecting cut-out of any of a number of functions within a system having serially interconnected devices.

In addition to the objectives and advantages listed above, various other objectives and advantages of the present invention will become more readily apparent to persons skilled in the relevant art from a reading of the detailed description section of this document. The other objectives and advantages will become particularly apparent when the detailed description is considered along with the attached drawings and with the appended claims.

SUMMARY OF THE INVENTION

In a presently preferred embodiment, the present invention provides a system for detecting cut-out of brakes on vehicles of a train. Each of the vehicles has at least one truck with brakes thereon. The system includes a frequency generator means, a plurality of cut-out cocks, a plurality of frequency divider means and a detector means. The frequency generator means generates a signal at a predesignated frequency. This signal is conveyed from a first vehicle in the train to a last vehicle in the train along a feed line and from the last vehicle to the first vehicle along a return line. Each truck has a cut-out cock installed between the brake cylinder control valve and the brake cylinder(s). Each cut-out cock can assume either an open position wherein the brakes of its truck are cut-in or a closed position wherein the brakes of its truck are cut-out. Each cut-out cock features a switch in series with the return line. A switch closes when its cutout cock assumes the open position and opens when its cutout cock assumes the closed position. Each frequency divider means connects in parallel circuit relationship with one of the cut-out cock switches. When a switch is closed, the signal passes through the switch thereby causing no division of frequency. When the switch is open, the signal passes through its corresponding frequency divider means thereby causing division of its frequency by a preset value. The detector means is located in the first vehicle where it receives the signal returning on the return line. The detector means determines the resulting frequency of the signal because the signal as it conducted along the return line had its frequency divided by the preset value each time it passed through one of the frequency divider means. The system can then determine how many of cut-out cocks on the train are closed and the number of trucks whose brakes are cut-out on the train.

DETAILED DESCRIPTION OF THE INVENTION

Figure 1:
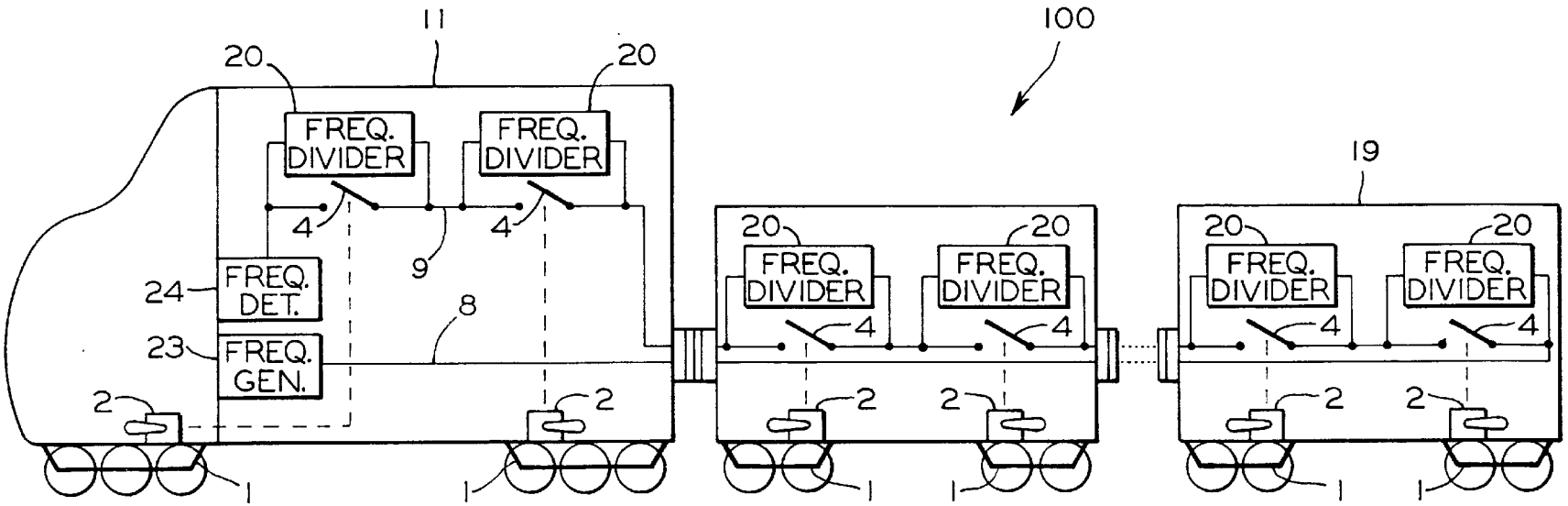
FIG. 1 is a block diagram view of a train equipped with a system for detecting cut-out of brakes on a train according to the present invention.

Before describing the present invention in detail, the reader is advised that, for the sake of clarity and understanding, identical components having identical functions in each of the accompanying drawings have been marked with the same reference numerals in both of the Figures provided in this document.

Figure 2:
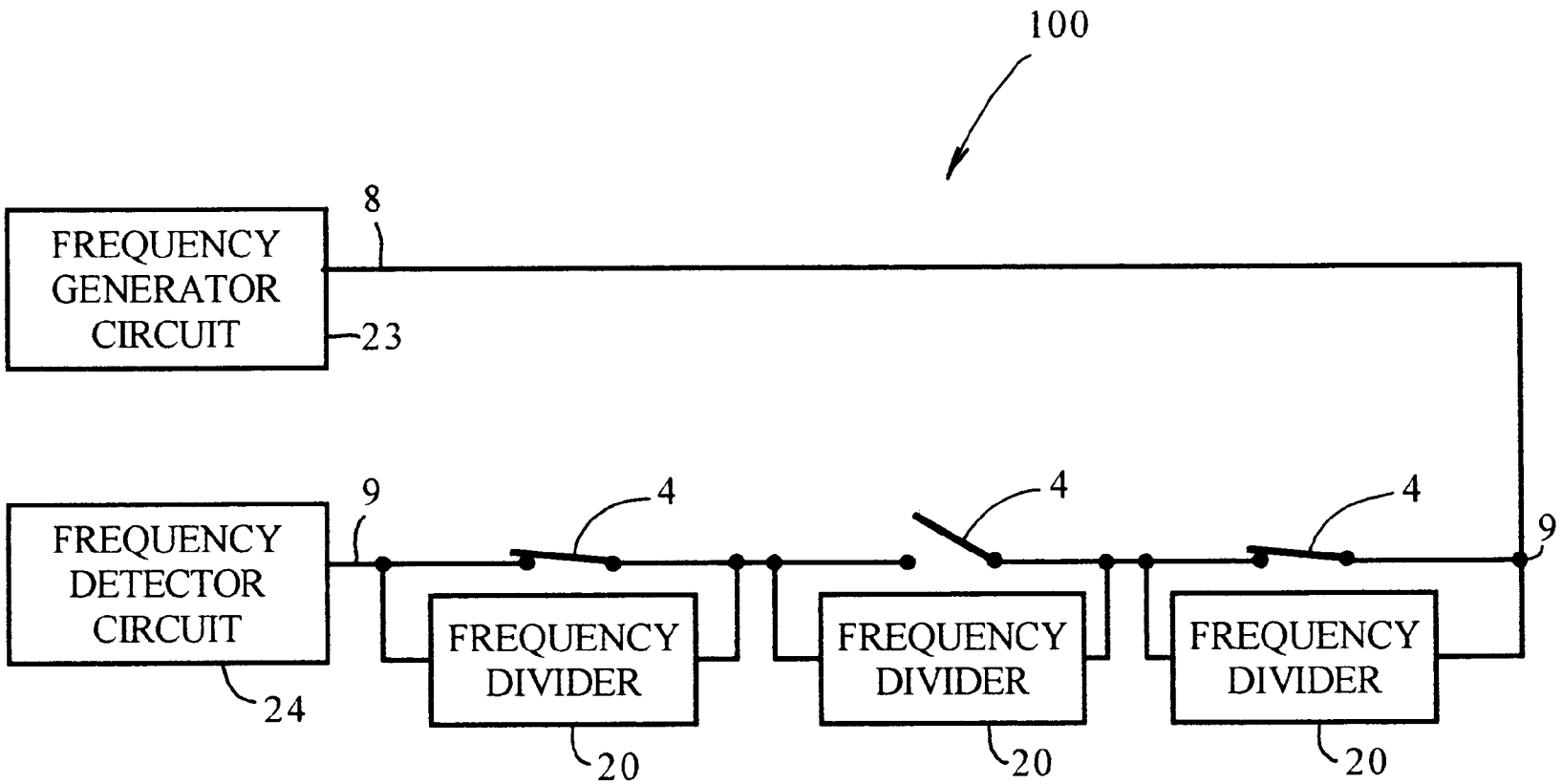
FIG. 2 is a simplified block diagram of a system for detecting cut-out either of brakes on a train or of any other function within a given mechanism.

FIGS. 1 and 2 each illustrate the essential details of the present invention. Specifically, FIG. 1 shows the present invention as it can be used with a train having a locomotive and a plurality of other rail vehicles. FIG. 2 shows the present invention as it can be used not only with trains but also with other serially interconnected devices even those unrelated to the rail transportation industry.

Referring first to FIG. 1, the present invention in a presently preferred embodiment provides a system for detecting cutout of brakes on vehicles of a train. Each of the vehicles of the train has at least one truck 1 equipped, of course, with the requisite brake equipment. The brake equipment includes a brake cylinder control valve (not shown), one or more brake cylinders (not shown) and a cut-out cock 2. Generally designated by reference numeral 100, the present system for detecting cut-out of brakes generally includes a plurality of cut-out cocks 2, a plurality of frequency divider circuits 20, a frequency generator circuit 23 and a detector circuit 24.

The frequency generator circuit 23 may take the form of any one of a variety of commercially available chips or circuit designs well known in the electronic arts. The frequency generator circuit 23 generates a signal at a predesignated frequency. This signal is conveyed from a first vehicle 11 in the train to a last vehicle 19 in the train along a feed line 8 and from the last vehicle 19 to the first vehicle 11 along a return line 9.

The cut-out cocks 2 of the present invention are devices whose construction and operation are well known in the brake control art. An example of a cut-out cock that could be employed in the present invention is shown and described in Operation & Maintenance Publication No. 4216-04, S.54, published by the Westinghouse Air Brake Company (WABCO).

The brakes of a truck 1 may be cut-out (i.e., rendered inoperable) via its cut-out cock 2. The cut-out cock 2 is a manually operated pneumatic valve that is situated between the brake cylinder control valve and the brake cylinder(s) of each truck 1. The cut-out cock 2 typically has a lever that is used by a railyard worker to open or close the cut-out cock as desired. Being a normally open valve, the cut-out cock 2 may be closed if a problem with the brakes of a truck 1 is detected before the train leaves a station. When closed, a cut-out cock 2 prevents air from flowing from the brake cylinder control valve to the brake cylinder(s) of its truck thereby depriving the truck of its brakes. Each cut-out cock 2 can thus assume an open position wherein the brakes of its truck 1 are cut-in or a closed position wherein the brakes of its truck 1 are cut-out.

As described in the aforementioned publication, each cutout cock 2 features a switch 4. When employed in the present invention 100, each cut-out cock switch 4 is connected in series with the return line 9 as shown in FIG. 1. Each switch 4 closes when its cutout cock 2 assumes the open position and opens when its cutout cock 2 assumes the closed position. When closed, the switch 4 allows a signal to pass between its contacts thereby providing an indication that its cut-out cock 2 is open and its corresponding truck brakes are operational. When open, the switch 4 prevents a signal from passing between its contacts.

The frequency divider circuits 20 of the present invention 100 may be selected from of any one of a variety of commercially available chips or circuit designs well known in the electronic arts. Each frequency divider circuit 20 connects in parallel circuit relationship with one of the cut-out cock switches 4. When a switch 4 is closed, the signal passes through the switch 4 thereby causing no division of frequency. When the switch 4 is open, the signal passes through its corresponding frequency divider circuit 20 thereby causing division of its frequency by a preset value. The preset value for the present invention 100 is preferably chosen to be two.

The detector circuit 24 may take the form of any one of a variety of commercially available chips or circuit designs well known in the electronic arts. As employed in the present invention 100, the detector circuit 24 is located in the first vehicle 11 where it receives the signal returning on the return line 9. The detector circuit 24 must determine the resulting frequency of the signal because the signal as it conducted along the return line 9 of the train had its frequency divided by the preset value each time it passed through one of the frequency divider circuits 20. Given the predesignated frequency of the signal initially conveyed along feed line 8 and the resulting frequency of the signal ultimately returned along return line 9, the present system can determine how many of the cut-out cocks have been closed on the train. The number of closed cut-out cocks, of course, equals the number of trucks whose brakes have been cut-out on the train.

The present invention 100 may determine the number of cut-out trucks on the train using any one of a variety of computing means commonly found on today's trains. An example of such a computing means is the WABCO EPIC® Brake Control System used by many rail transportation authorities. Alternatively, a separate computer device dedicated solely to the present invention may serve as the computing means. Moreover, this dedicated computer device could be incorporated into the same enclosure as the frequency generator circuit 23 or detector circuit 24, as shown in FIGS. 1 and 2. Though space and weight factors among others may favor choosing the former alternative, one of ordinary skill in the relevant art has the requisite competence to make and use the present invention no matter which alternative is selected.

Regarding the function of the computing means, the computing means receives the predesignated frequency from the frequency generator circuit 23 and the resulting frequency from the detector circuit 24. The computing means uses that information to determine how many cut-out cocks 2 on the train are closed and thus the number of trucks 1 whose brakes are cut-out on the train.

The computing means may also be used to direct the train into a mode of restricted operation if more than a preset percentage of trucks 1 on the train have their brakes cut-out. Though it depends on various other factors known to persons of ordinary skill in the train control art, the preset percentage should preferably be chosen as about twenty percent (20%). Whether the computing means takes the form of an existing system such as the WABCO EPIC® Brake Control System or a dedicated computer device, the present invention 100 would provide the requisite input to the train control system should restricted operation become necessary. The restricted operation may manifest itself as an upper limit on the speed of the train or any other desired limitation on the operation of the train.

The present invention may also include a display for displaying the results of this determination to an operator of the train. The display may be one that is already found on the train such as the display associated with the aforementioned EPIC® Brake Control System. Alternatively, a separate display dedicated solely to the present invention 100 may be preferable. Like the computer means, the display could be incorporated into the same enclosure as the frequency generator circuit 23 or the detector circuit 24, as shown in FIGS. 1 and 2. Space, weight and other factors ultimately determine which alternative is selected.

It should be apparent that the predesignated frequency at which the frequency generator emits the signal should be selected based on the length of the train with which the present invention is to be used. Each of the rail vehicles of a train generally has two trucks, with each truck having one frequency divider circuit 20. A train consisting of only ten vehicles will therefore have twenty frequency divider circuits 20. Assume one were to choose a predesignated frequency of one megahertz for the signal on a train of such length. If the brakes on each truck were to be cut-out, the signal would pass through all twenty frequency divider circuits 20 on the train. The signal received by the detector circuit 24 would have a (resulting) frequency of only one hertz approximately.

The predesignated frequency should thus be selected with regard to the equation $F_P=F_R \times y^N$ where $F_P$ is the predesignated frequency at which the signal is emitted by the frequency generator circuit 23; y is the preset value or divisor of each frequency divider circuit 20; N is the number of frequency divider circuits 20 in the train; and $F_R$ is the (resulting) frequency to be detected by the detector circuit 24. Accordingly, the present system 100 is preferably intended to be used with trains of relatively short length. Passenger transit trains, subway trains, elevated trains, and trolley lines are examples of applications to which the present system 100 is best applied.

For obvious reasons, the predesignated frequency should ideally be selected such that it is sufficiently different from all other signal frequencies that may be found on the trainlines.

It should be apparent that the present invention could also be implemented in a variety of other mechanisms. Typically, such other mechanisms would each comprise a group of serially interconnected items each of which having a certain event(s) or function(s) that lends itself to such monitoring. Used in such other mechanisms the present invention could detect the "cut-out" or "cut-in" of such a function or the occurrence or non-occurrence of such an event in such group of serially interconnected items. The present invention 100 thus need not be confined solely to the rail transportation context.

While the presently preferred embodiment for carrying out the present invention has been set forth in detail according to the Patent Act, those persons of ordinary skill in the technical art to which this invention pertains will recognize various alternative ways of practicing the invention without departing from the spirit and scope of the appended claims. Those of ordinary skill will also recognize that the foregoing description is merely illustrative and is not intended to limit any of the following claims to any particular narrow interpretation.

Accordingly, to promote the progress of science and useful arts, we secure for ourselves by Letters Patent exclusive rights to all subject matter embraced by the following claims for the time prescribed by the Patent Act.

We claim:

1. A system for detecting cut-out of function in a mechanism composed of a group of serially interconnected items, each of said items for performing said function, said system comprising:

(a) a frequency generator circuit for generating a signal at a predesignated frequency for conveyance from a first item in said mechanism to a last item in said mechanism along a feed line and from said last item to said first item along a return line;

(b) a switch for each of said items in series with said return line such that said switch closes when said item performs said function and opens when said item fails to perform said function;

(c) a frequency divider circuit for connection in parallel circuit relationship with each of said switches such that (i) when said switch is closed, said signal passes through said switch wherein division of frequency is avoided and (ii) when said switch is open, said signal passes through said frequency divider circuit wherein division of frequency by a preset value occurs;

(d) a detector circuit for determining a resulting frequency of said signal returned to said first item on said return line as said signal as it conducted along said return line had its frequency divided by said preset value each time it passed through one of said frequency divider circuits; and (e) a computer for receiving said predesignated frequency from said frequency generator circuit and said resulting frequency from said detector circuit for determining the number of said items which failed to perform said function.

2. A system for detecting cut-out of brakes on vehicles of a train, each of said vehicles having at least one truck with brakes thereon, said system comprising:

(a) a frequency generator circuit for generating a signal at a predesignated frequency for conveyance from a first vehicle in said train to a last vehicle in said train along a feed line and from said last vehicle to said first vehicle along a return line;

(b) a cut-out cock on each of said trucks, each of said cut-out cocks for assuming an open position wherein said brakes of said truck corresponding thereto are cut-in and a closed position wherein said brakes of said truck corresponding thereto are cut-out, each of said cut-out cocks featuring a switch in series with said return line that closes when said cutout cock corresponding thereto assumes said open position and that opens when said cutout cock corresponding thereto assumes said closed position;

(c) a frequency divider circuit for each of said cut-out cocks connected in parallel circuit relationship with said switch thereof such that (i) when said switch is closed, said signal passes through said switch wherein division of frequency is avoided and (ii) when said switch is open, said signal passes through said frequency divider circuit wherein division of frequency by a preset value occurs; and (d) a detector circuit for determining a resulting frequency of said signal returned to said first vehicle on said return line as said signal as it conducted along said return line had its frequency divided by said preset value each time it passed through one of said frequency divider circuits thereby enabling said system to determine how many of said cut-out cocks on said train are closed and the number of said trucks whose said brakes are cut-out on said train.

3. The system for detecting cut-out of brakes recited in claim 2 wherein said train includes a computer for receiving said predesignated frequency from said frequency generator circuit and said resulting frequency from said detector circuit for performing said determination of the number of said trucks whose said brakes are cut-out on said train.

4. The system for detecting cut-out of brakes recited in claim 3 wherein said computer is part of said system.

5. The system for detecting cut-out of brakes recited in claim 4 wherein said train includes a display for displaying the results of said determination.

6. The system for detecting cut-out of brakes recited in claim 5 wherein said display is part of said system.

7. The system for detecting cut-out of brakes recited in claim 6 wherein said computer directs said train into a mode of restricted operation if more than a preset percentage of said trucks on said train have said brakes cut-out.

8. The system for detecting cut-out of brakes recited in claim 2 wherein said preset value is an integer.

9. The system for detecting cut-out of brakes recited in claim 8 wherein said train operates in a mode of restricted operation if more than a preset percentage of said trucks on said train have said brakes cut-out.

10. The system for detecting cut-out of brakes recited in claim 3 wherein said train includes a display for displaying the results of said determination.

11. The system for detecting cut-out of brakes recited in claim 10 wherein said computer directs said train into a mode of restricted operation if more than a preset percentage of said trucks on said train have said brakes cut-out.

12. A system for detecting cut-out of brakes on vehicles of a train, each of said vehicles having at least one truck with brakes thereon, said system comprising:

(a) a frequency generator circuit for generating a signal at a predesignated frequency for conveyance from a first vehicle in said train to a last vehicle in said train along a feed line and from said last vehicle to said first vehicle along a return line;

(b) a cut-out cock on each of said trucks for assuming either an open position wherein said brakes of said truck are cut-in or a closed position wherein said brakes of said truck are cut-out, said cut-out cock featuring a switch in series with said return line that closes when said cutout cock assumes said open position and that opens when said cutout cock assumes said closed position;

(c) a frequency divider circuit for connection in parallel circuit relationship with each of said switches such that (i) when said switch is closed, said signal passes through said switch wherein division of frequency is avoided and (ii) when said switch is open, said signal passes through said frequency divider circuit wherein division of frequency by a preset value occurs;

(d) a detector circuit for determining a resulting frequency of said signal returned to said first vehicle on said return line as said signal as it conducted along said return line had its frequency divided by said preset value each time it passed through one of said frequency divider circuits; and (e) a computer for receiving said predesignated frequency from said frequency generator circuit and said resulting frequency from said detector circuit for determining the number of said trucks whose said brakes are cut-out on said train.

13. The system for detecting cut-out of brakes recited in claim 12 wherein said computer is a locomotive computer of said train.

14. The system for detecting cut-out of brakes recited in claim 13 wherein said train includes a display for displaying the results of said determination.

15. The system for detecting cut-out of brakes recited in claim 14 wherein said preset value is an integer.

16. The system for detecting cut-out of brakes recited in claim 15 wherein said computer directs said train into a mode of restricted operation if more than a preset percentage of said trucks on said train have said brakes cut-out.

17. The system for detecting cut-out of brakes recited in claim 12 wherein said system includes a display for displaying the results of said determination.

18. The system for detecting cut-out of brakes recited in claim 17 wherein said preset value is an integer.

19. The system for detecting cut-out of brakes recited in claim 18 wherein said computer directs said train into a mode of restricted operation if more than a preset percentage of said trucks on said train have said brakes cut-out.

20. A system for detecting cut-out of brakes on vehicles of a train, each of said vehicles having at least one truck with brakes thereon, said system comprising:

(a) a frequency generating means for generating a signal at a predesignated frequency for conveyance from a first vehicle in said train to a last vehicle in said train along a feed line and from said last vehicle to said first vehicle along a return line;

(b) a cut-out cock on each of said trucks for assuming an open position wherein said brakes of said truck are cut-in and a closed position wherein said brakes of said truck are cut-out, said cut-out cock featuring a switch in series with said return line that closes when said cutout cock assumes said open position and that opens when said cutout cock assumes said closed position;

(c) a frequency dividing means for each of said switches and connected in parallel circuit relationship therewith such that (i) when said switch is closed, said signal passes through said switch wherein division of frequency is avoided and (ii) when said switch is open, said signal passes through said frequency dividing means wherein division of frequency by a preset value occurs;

(d) a detecting means for determining a resulting frequency of said signal returned to said first vehicle on said return line as said signal as it conducted along said return line had its frequency divided by said preset value each time it passed through one of said frequency dividing means;

(e) a computing means for receiving said predesignated frequency from said frequency generating means and said resulting frequency from said detecting means for determining the number of said trucks whose said brakes are cut-out on said train; and (f) a display means for displaying the results of said determination.

* * * * *